US005378186A

United States Patent [19]

Becker

[11] Patent Number: 5,378,186

[45] Date of Patent: Jan. 3, 1995

[54] BALLOON ASSEMBLY CONNECTED BY TAB AND ENCIRCLING COLLAR

[75] Inventor: Charles R. Becker, Chicago, Ill.

[73] Assignee: M & D Balloons, Inc., Manteno, Ill.

[21] Appl. No.: 179,114

[22] Filed: Jan. 10, 1994

[51] Int. Cl.[6] ..... A63H 3/06

[52] U.S. Cl. ..... 446/220; 446/223; 446/221

[58] Field of Search ..... 446/220, 221, 222, 223, 446/224, 225, 226, 391, 97, 98, 100; 24/573.1

[56] References Cited

U.S. PATENT DOCUMENTS

| | | | |
|---|---|---|---|
| 1,483,150 | 2/1924 | Witten | 446/226 |
| 1,510,554 | 10/1924 | Lee | 446/224 |
| 1,916,811 | 7/1933 | Schwartz | 446/100 |
| 2,008,552 | 7/1935 | Jacobs | 446/221 |
| 2,134,063 | 10/1938 | Turchanyi | 446/221 |
| 2,731,768 | 1/1956 | Harrowe | 446/226 |
| 3,230,663 | 1/1966 | Shabram . | |
| 3,493,228 | 2/1970 | Hicks et al. | 446/220 |
| 3,626,634 | 12/1971 | Jones et al. | 446/221 |
| 3,994,102 | 11/1976 | Johnson et al. | 446/220 |
| 4,778,431 | 10/1988 | Dudley | 446/221 |
| 5,169,353 | 12/1992 | Myers | 446/221 |

FOREIGN PATENT DOCUMENTS

| | | | |
|---|---|---|---|
| 638631 | 10/1936 | Germany | 446/220 |

*Primary Examiner*—Robert A. Hafer
*Assistant Examiner*—Jeffrey D. Carlson
*Attorney, Agent, or Firm*—Fitch, Even, Tabin & Flannery

[57] ABSTRACT

A balloon of at least two balloons is facilitated by a connecting tab on one balloon joined to a collar on another balloon. The collar wraps around the connecting tab to contribute to the aesthetic appearance of the balloon assembly by hiding the balloon joinder.

18 Claims, 3 Drawing Sheets

BALLOON ASSEMBLY CONNECTED BY TAB AND ENCIRCLING COLLAR

BACKGROUND OF THE INVENTION

1. Field of the Invention

The present invention pertains to balloon products, and in particular to such products formed by attaching individual balloons together.

2. Description of the Related Art

Efforts have been made over the years to provide balloon products, especially toy balloons emulating familiar three-dimensional shapes, such as those of animals. One example is given in U.S. Pat. No. 3,230,663. Although substantial advances have been made in the art of forming three-dimensional shapes from a single balloon, balloon products formed by the joinder of two or more individual balloons have become commonplace in many channels of trade. One example of such a balloon is given in U.S. Pat. No. 5,169,353. Provisions are made for mechanically interlocking two balloons together, by providing a slot formed in one balloon, for receiving a finger-like member extending from another balloon.

SUMMARY OF THE INVENTION

It is an object of the present invention to provide a balloon product formed by the joinder of two or more individual balloons.

While it is important to mechanically join the balloons together to prevent their unintentional separation, it is also important in some applications to preserve a defined spatial orientation between the joined balloons. Balloons can be filled at different pressures with different inflating gases, and these conditions also affect the relative positioning of the joined balloons. It is an object of the present invention to improve spatial orientation among the joined balloons, despite varying conditions.

A further object of the present invention is to provide a balloon assembly made from a fewer number of less expensive components with a lesser labor investment. It is also an object of the present invention to eliminate the need for external products beyond the balloons themselves, while providing an attractive aesthetic appearance.

These and other objects according to principles of the present invention, which will become apparent from studying the appended description and drawings, are provided in a balloon assembly comprising:

a first balloon having a body portion and a connecting tab extending outwardly therefrom;

a second balloon having a body portion with a collar member extending outwardly therefrom;

joining means carried on at least one of the first and the second balloons for joining the connecting tab to a medial portion of the collar member; and the collar member configured so as to wrap over the connecting tab when joined to the collar member, to form a closed loop at least partly covering the connecting tab.

DETAILED DESCRIPTION OF THE PREFERRED EMBODIMENT

Figure 1:
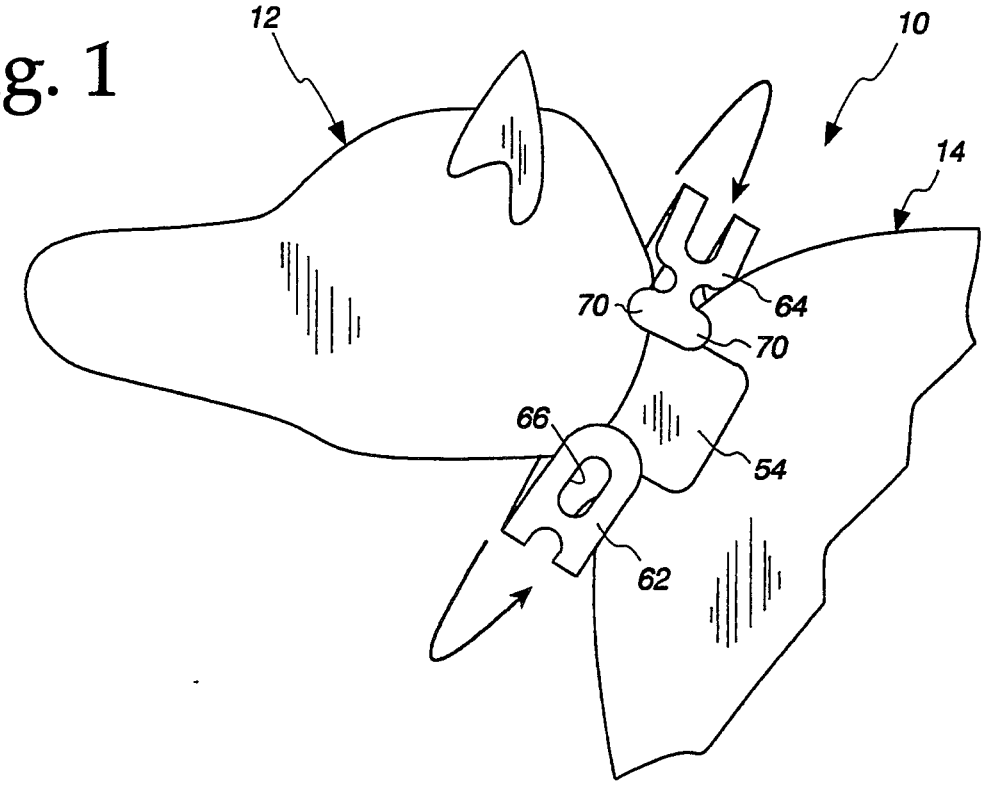
FIG. 1 is a fragmentary perspective view of a balloon assembly according to principles of the present invention.
Figure 2:
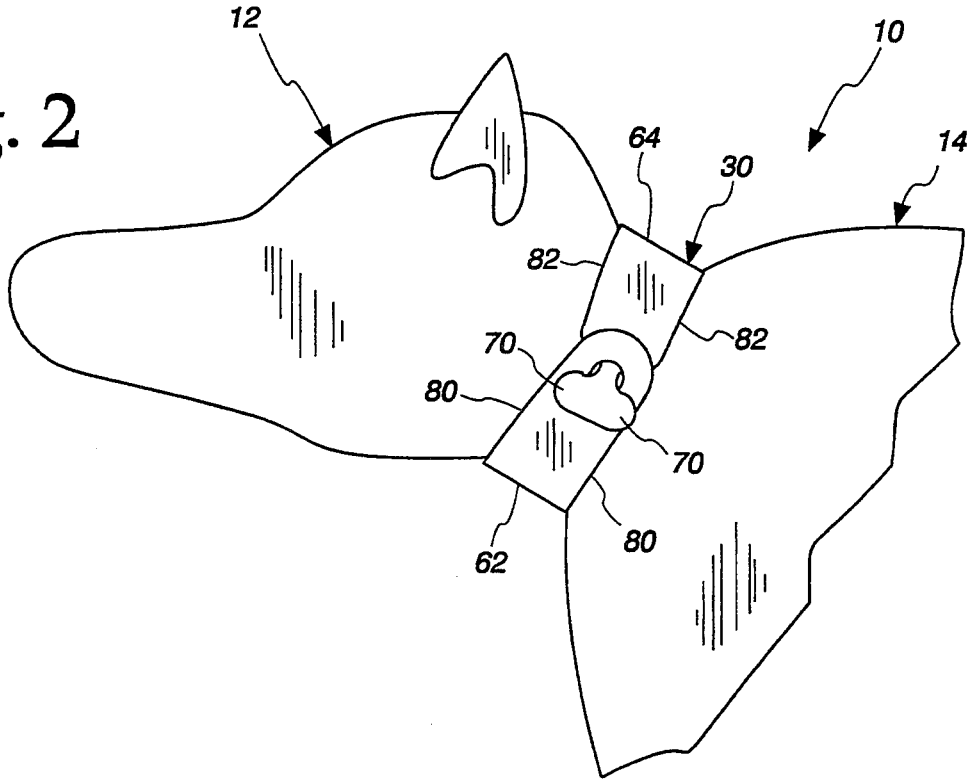
FIG. 2 shows the balloon assembly of FIG. 1 in a fully assembled condition.

Referring now to the drawings, and initially to FIG. 1, a balloon assembly is generally indicated at 10. In its preferred form, assembly 10 comprises the joinder of two balloons, designated 12 and 14. For purposes of illustration only, balloon 12 is formed in the shape of an animal head, while balloon 14 is formed in the shape of an animal body, the balloons 12, 14 cooperating together to form a three-dimensional form. In the preferred embodiment, balloons 12, 14 are joined at overlapping tab and collar members, which will be explained herein. FIG. 2 shows the collar member in a fully assembled condition, adding to the aesthetic appearance of the balloon assembly by hiding the joinder of the balloons and by providing a contrasting collar design, if desired.

Figure 3:
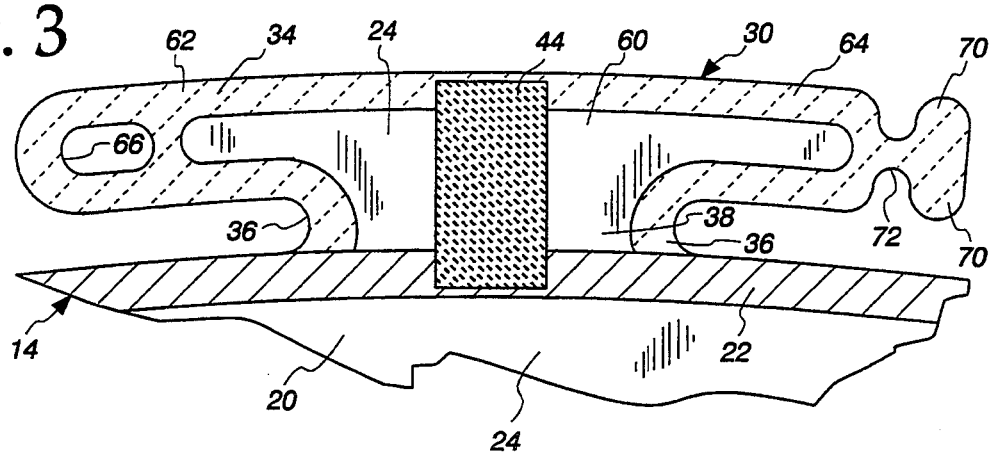
FIG. 3 is a fragmentary plan view of one of the balloons illustrated in FIGS. 1 and 2.

Referring now to FIG. 3, balloon 14 includes a body portion 20 joined at its outer periphery by a balloon seal 22. In its preferred form, balloon 14 is formed by a pair of overlapping balloon films preferably, but not necessarily, having the same general shape. In the preferred embodiment, balloon 14 (as with balloon 12) is formed from nonlatex films with the balloon seal 22, as well as other seals to be described herein, formed by heat and pressure applied to overlapping film layers. The balloon seal, as illustrated in FIG. 3 and other Figures, has a substantial size and, when formed, results in a fairly rigid spine. In the preferred embodiment, balloon seal 22 extends around the outer periphery of balloon 14 in a common seal plane. In the preferred embodiment, the balloon seal forms a pressure vessel, familiar to toy balloons. Due to the added rigidity offered by balloon seal 22, twisting out of the seal plane or collapse into the interior of the seal plane is effectively prohibited.

Referring again to FIG. 3, balloon 14 includes an outwardly extending collar portion generally indicated at 30. In the preferred embodiment, collar 30 is formed as an integral extension of the balloon films comprising the pressure vessel portion of balloon 14. For example, the balloon film 24, visible in FIG. 3, extends from the body portion 20 to collar 30, being either fully or partly interrupted or separated by balloon seal 22. A collar seal 34 joins the edges of the balloon films forming collar 30. Preferably, collar seal 34 is formed by heat and pressure, and thus shares the rigidifying and plane-orienting qualities of the balloon seal 22. In the preferred embodiment, a common sealing die simultaneously forms balloon seal 22 and collar seal 34, with the balloon and collar seals lying in a common plane.

The interior region 38 of collar 30 is left unsealed. As illustrated in FIG. 3, the interior region 38 of the collar is completely surrounded by seals formed by heat and pressure. If desired, the interior region 38 could also be sealed under heat and pressure, although this has not been found necessary, and in some applications it is desirable to maintain the surface appearance of the films forming collar 30 in an unaltered state, as sometimes occurs with the application of heat and pressure.

Collar 30 can be separately formed if desired. Also, even though integrally formed with the balloon films, collar 30 can be treated in a different manner than the pressure vessel portion of the balloon. For example, collar 30 can be treated with added heat or pressure than that desirable for the pressure vessel portion of the balloon. As a further alternative, an intermediate layer of polyethylene coated paper or other material may be provided between the film layers of collar 30, to provide added stiffness or to meet some other need as may arise. Additionally, added layers may be attached to an outside surface of collar 30. In these alternatives, the collar can be subjected to manufacturing treatments which may not be suitable for the pressure vessel portion of the balloon.

Referring again to FIG. 3, the preferred method of joining the balloons together is with adhesive. An adhesive layer 44 is applied to a medial portion of collar 30. As illustrated, adhesive portion 44 overlaps seals 34, 22, although this is not necessary in all instances. If desired, the adhesive portion 44 could overlap a portion of balloon body 20, although it will be realized that, unlike collar 30, balloon body 20 departs from a flat, planar configuration once inflated.

As mentioned, collar seal 34 cooperates with balloon seal 22 to completely surround the collar interior portion 38. Collar seal 34 includes rounded connecting portions 36, although this feature could be eliminated, if desired, with portions of the collar seal blending into balloon seal 22, to be severed therefrom by cutting after the seal is formed. In its preferred form, the collar 30 is elongated, having a central axis extending generally parallel to the balloon seal 22.

Figure 4:
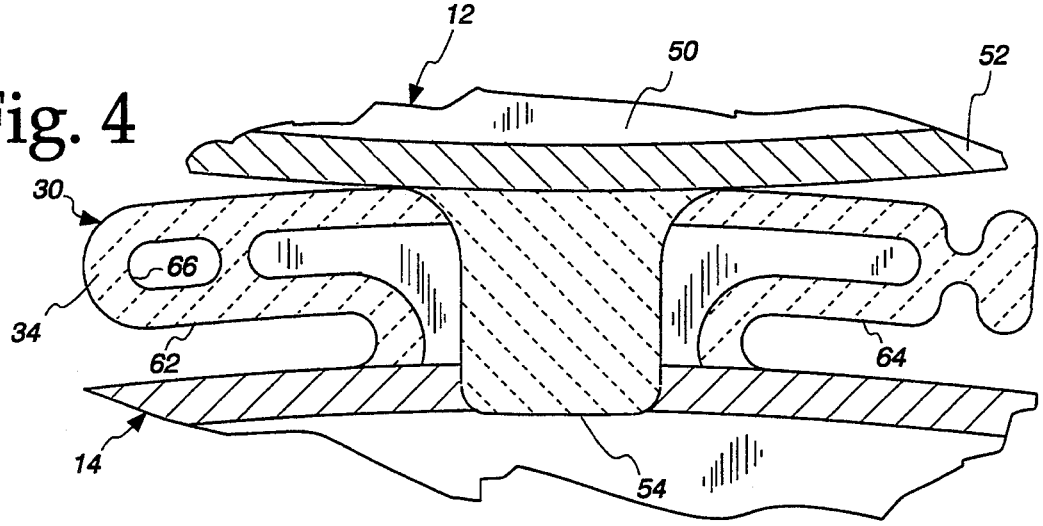
FIG. 4 is a fragmentary plan view showing the joinder of the balloons.

Referring now to FIG. 4, balloon 12 has a body portion 50 sealed at its outer periphery by a balloon seal 52. A connecting tab 54 extends from balloon seal 52 and is preferably formed as an integral extension thereof, by using the same sealing die to form both features 52, 54. The connecting tab 54 can conveniently comprise the filler neck of a conventional latex or nonlatex balloon. As can be seen from FIG. 4, connecting tab 54 has a substantial width, corresponding generally in size to a central portion 60 of collar 30 (i.e., that portion between rounded connecting members 36). If desired, an adhesive layer similar to that of the aforementioned adhesive layer 44 can be applied also to connecting tab 54 for added securement to balloon 14, although this has, in general, been found unnecessary.

Referring again to FIG. 3, the central portion 60 of collar 30 extends between rounded portions 36 with a pair of generally opposed, interlocking end members 62, 64. End portion 62 has an aperture 66 formed therein, while end portion 64 has enlarged ears 70 joined to the collar by a connecting strap 72. As can be seen in FIG. 4, the tab and collar are configured so that the end portions 62, 64 extend beyond the connecting tab 54 to facilitate their being wrapped over the exposed upper surface of connecting tab 54 in the manner illustrated in FIG. 5.

Figure 5:
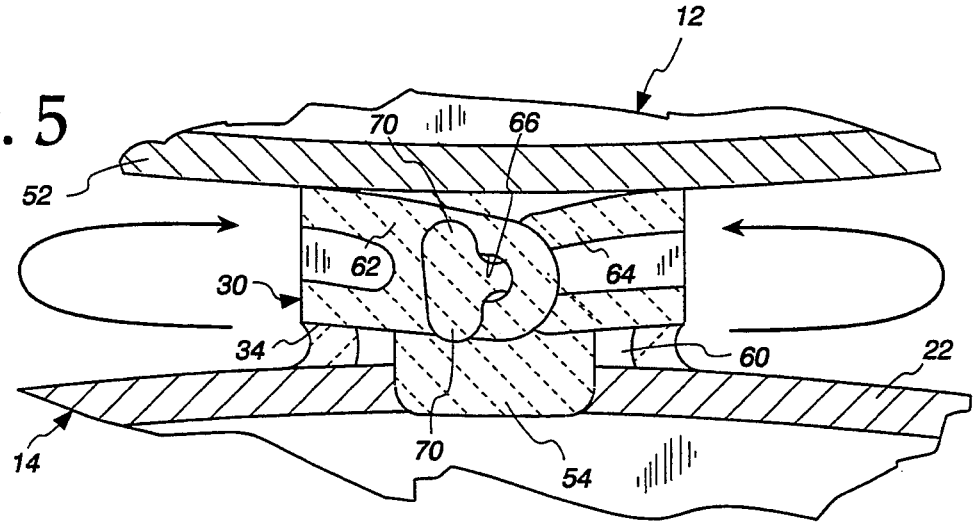
FIG. 5 is a view similar to that of FIG. 4, but showing the collar in a fully assembled position.

As indicated in FIG. 5, the connecting tab 54 is secured by adhesive layer 44 to central portion 60 of collar 30. The end portions 62, 64 interengage one another, with enlarged ears 70 passing through aperture 66 so as to form a closed loop. As illustrated in the Figures, the closed loop is dimensioned to have a size which precludes intimate engagement with the exposed surface of connecting tab 54, although such could be provided if desired. To further facilitate this optional feature, an adhesive coating could be provided on the exposed surface 54 to provide adhesive securement of collar 30 thereto. In the preferred embodiment, however, it is generally desired that the collar 30 have the aesthetic appearance of a separate design element resembling a collar disposed about the animal's neck. When closed in the manner illustrated in FIG. 5, collar 30 covers (either partly or completely, as desired) the connection of the two balloons, thus adding substantially to the appearance of the completed balloon assembly.

As can be seen in FIG. 5, the balloon seals 52, 22 and the major portion of collar seal 34, as well as connecting tab 54, all lie substantially in a common plane and all have rigid qualities, being formed by heat and pressure, thus fixing the relative attitude between balloon 12, 14.

It is recognized that, under some circumstances, the balloons may bend about flex lines extending generally parallel to the balloon seals. For purposes of illustration, this flexing may be visualized as side-to-side movement of the animal head in FIGS. 1 and 2. If desired, this lateral flexing can be reduced or eliminated by shaping the balloon films and controlling their inflation pressures (or dimensioning the circumference of the collar) so as to bring the balloon bodies into contact with the peripheral edges 80, 82 of end portions 62, 64, as shown in FIG. 2. To further augment an internal "hoop" stress within the formed collar 30, the interior portion 38 of collar 30 can be inflated, or as a further alternative, the connecting tab 54 can be inflated. With the collar constructed according to principles of the present invention, an additional foam pad or other spacing device could be inserted within collar 30 without marring the aesthetic appearance of the balloon assembly, since any such added device could be hidden by collar 30.

Figure 6:
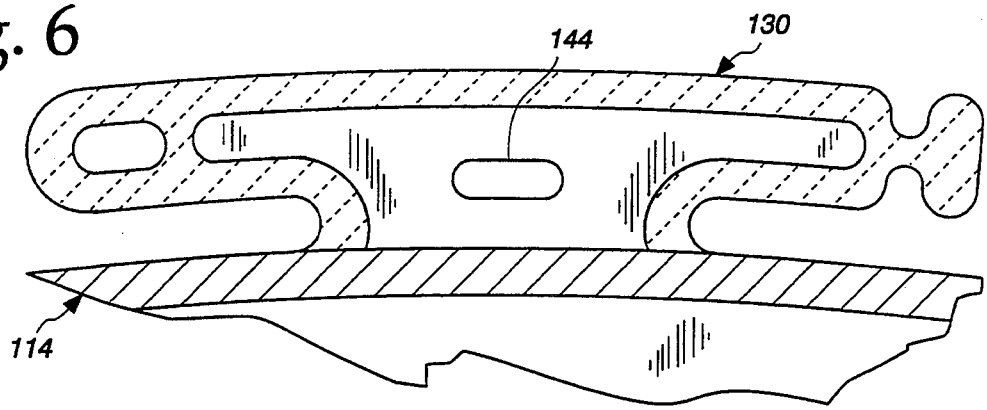
FIG. 6 is a fragmentary plan view of an alternative balloon construction.
Figure 7:
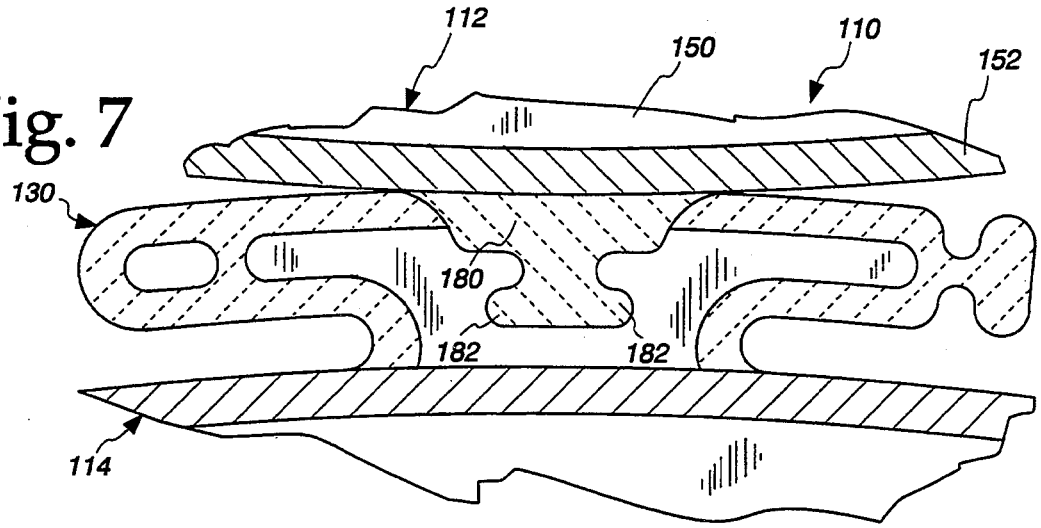
FIG. 7 is a fragmentary plan view showing a joinder thereof with another alternative balloon construction.
Figure 8:
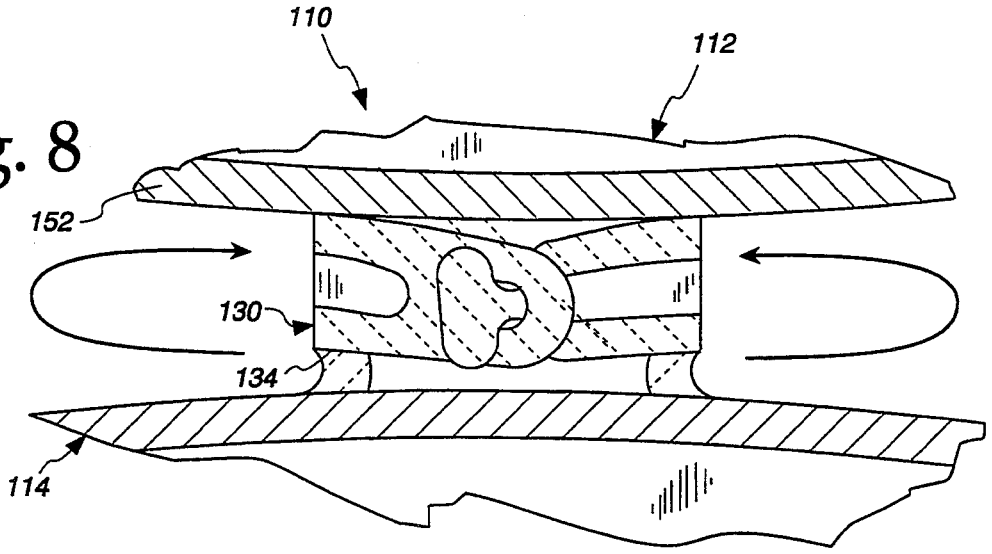
FIG. 8 is a view similar to that of FIG. 7, but showing the collar in a fully assembled position.

Turning now to FIGS. 6–8, an alternative balloon assembly is generally indicated at 110 (see FIGS. 7 and 8). The balloon assembly 110 comprises the joinder of balloons 112, 114. Balloon 114 is substantially similar to balloon 14 described above with reference to FIG. 3, except that the adhesive layer 44 is omitted, and replaced by an aperture 144 which extends through the layers forming the collar 130. FIG. 7 shows a balloon 112 having a body portion 150 preferably formed by the overlapping balloon films joined at their outer periphery by a balloon seal 152. A tab 180 extends from balloon seal 152 and includes enlarged locking ears 182. The locking ears are overlaid over aperture 144, as shown in FIG. 7, in preparation of interlocking engagement, by passing the locking ears through the layers of collar 130. FIG. 8 shows the covering of the mechanical joinder of balloons 112, 114 by the closure of collar 130. Collar seal 134 is substantially identical to the collar seal 34 described above with reference to FIGS. 3–5.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A balloon assembly comprising:

a first balloon having a body portion and a connecting tab extending outwardly therefrom;

a second balloon having a body portion with a collar member extending outwardly therefrom;

joining means carried on at least one of the first or the second balloons for joining the connecting tab to a medial portion of the collar member; and the collar member having a T-shape with a head part and a stem part which extends outwardly from the second balloon;

the head part having the medial portion between first and second opposed end portions each carrying coupling means for coupling the end portions together to form a closed loop, the head part configured so as to wrap over the connecting tab, forming a closed loop surrounding the connecting tab.

2. The balloon assembly of claim 1 wherein the first and second balloon bodies are formed by overlapping, respective balloons films each having an outer periphery, and sealing the balloon films at their outer periphery with respective balloon seals.

3. The balloon assembly of claim 2 wherein the balloon seals are formed by joining the balloon films together with heat and pressure so as to form rigid peripheral bands surrounding the balloon bodies.

4. The balloon assembly of claim 3 wherein the collar men%her is formed as an integral extension of the balloon films of the second balloon, with a medial portion unsealed and at least partly surrounded by a peripheral collar seal formed by applying heat and pressure to the balloon films.

5. The balloon assembly of claim 4 wherein the collar seal and the balloon seal cooperate to completely enclose the medial portion of the collar member.

6. The balloon assembly of claim 1 wherein the connecting tab has a generally flat, planar construction.

7. A balloon assembly of claim 1 wherein the coupling means comprise an aperture formed in the first end portion, and enlarged locking ears formed in the second end portion, which are received in the aperture with an interlocking engagement.

8. The balloon assembly of claim 1 wherein the joining means comprises an adhesive layer carried on at least one of the first and second balloons.

9. The balloon assembly of claim 1 wherein the joining means comprises an aperture formed in the collar member, and a locking ear carried on the connecting tab receivable in the collar aperture for interlocking engagement therewith.

10. A balloon assembly comprising:

a first balloon having a body portion comprising a pair of overlapping films having outer peripheries and joined together at their outer peripheries by a first balloon seal, and the first balloon further having a connecting tab extending outwardly from a portion of the first balloon seal;

a second balloon having a body comprising a pair of overlapping balloon films having outer peripheries and joined together at their outer peripheries by a second balloon seal, and a collar member outwardly extending from the second balloon seal, the collar member having a T-shape with a head part and a stem part which extends outwardly from the second balloon, the head part having a central portion between a pair of opposed end portions, the end portions having coupling means for coupling together so as to form a closed loop;

an adhesive layer carried by the central portion of the collar member; and the collar member configured so as to surround the connecting tab when the collar member is formed in a closed loop and the connecting tab is secured to said adhesive layer.

11. The balloon assembly of claim 10 wherein the balloon seals are formed by joining the balloon films together with heat and pressure so as to form rigid peripheral bands surrounding the balloon bodies.

12. The balloon assembly of claim 10 wherein the connecting tab has a generally flat, planar construction.

13. An assembly of claim 12 wherein the collar member has first and second opposed end portions each carrying coupling means for coupling the end portions together to form a closed loop.

14. A balloon assembly of claim 13 wherein the coupling means comprise an aperture formed in the first end portion, and enlarged locking ears formed in the second end portion, which are received in the aperture with an interlocking engagement.

15. A balloon assembly comprising:

a first balloon having a body portion and a connecting tab extending outwardly therefrom;

a second balloon having a body portion;

the first and second balloon bodies formed by overlapping, respective balloons films each having an outer periphery, and sealing the balloon films at their outer periphery with respective balloon seals formed by joining the balloon films together with heat and pressure so as to form rigid peripheral bands surrounding the balloon bodies;

the second balloon body portion having an outwardly extending collar member formed as an integral extension of the balloon films of the second balloon, with a medial portion unsealed and at least partly surrounded by a peripheral collar seal formed by applying heat and pressure to the balloon films;

the collar seal and the balloon seal cooperate to completely enclose the medial portion of the collar member;

joining means carried on at least one of the first or the second balloons for joining the connecting tab to a medial portion of the collar member; and the collar member configured so as to wrap over the connecting tab when joined to the collar member, to form a closed loop at least partly covering the connecting tab.

16. A balloon assembly comprising:

a first balloon having a body portion and a connecting tab extending outwardly therefrom;

a second balloon having a body portion with a collar member extending outwardly therefrom;

said collar men,bet having first and second opposed end portions each carrying coupling means for coupling the end portions together to form a closed loop;

said coupling means comprising an aperture formed in the first end portion, and enlarged locking ears formed in the second end portion, which are received in the aperture with an interlocking engagement;

joining means carried on at least one of the first or the second balloons for joining the connecting tab to a medial portion of the collar member; and the collar member configured so as to wrap over the connecting tab when joined to the collar member, to form a closed loop at least partly covering the connecting tab.

17. A balloon assembly comprising:

a first balloon having a body portion and a connecting tab extending outwardly therefrom;

a second balloon having a body portion with a collar member extending outwardly therefrom;

joining means carried on at least one of the first or the second balloons for joining the connecting tab to a medial portion of the collar member;

said joining means comprising an aperture formed in the collar member, and a locking ear carried on the connecting tab receivable in the collar aperture for interlocking engagement therewith; and the collar member configured so as to wrap over the connecting tab when joined to the collar member, to form a closed loop at least partly covering the connecting tab.

18. A balloon assembly comprising:

a first balloon having a body portion comprising a pair of overlapping films having outer peripheries and joined together at their outer peripheries by a first balloon seal, and the first balloon further having a connecting tab of generally flat, planar construction extending outwardly from a portion of the first balloon seal;

a second balloon having a body comprising a pair of overlapping balloon films having outer peripheries and joined together at their outer peripheries by a second balloon seal, and a collar member outwardly extending from the second balloon seal having a central portion between a pair of opposed end portions, the end portions having coupling means for coupling together so as to forth a closed loop;

the collar member having first and second opposed end portions each carrying coupling means for coupling the end portions together to form a closed loop;

the coupling means comprising an aperture formed in the first end portion, and enlarged locking ears formed in the second end portion, which are received in the aperture with an interlocking engagement;

an adhesive layer carried by the central portion of the collar member; and the collar member configured so as to at least partly cover the connecting tab when the connecting tab is secured to said adhesive layer.

* * * * *

UNITED STATES PATENT AND TRADEMARK OFFICE

CERTIFICATE OF CORRECTION

PATENT NO. :5,378,186

DATED :January 3, 1995

INVENTOR(S) :Becker

It is certified that error appears in the above-indentified patent and that said Letters Patent is hereby corrected as shown below:

Column 5, line 31, change "mem%her" to --member--.

Column 6, line 60, change "men,bet" to --member--.

Column 8, line 11, change "forth" to --form--.

Signed and Sealed this

Fourth Day of April, 1995

*Attest:*

Bruce Lehman

BRUCE LEHMAN

*Attesting Officer*

*Commissioner of Patents and Trademarks*